United States Patent [19]

Hatchell

[11] 4,417,659

[45] Nov. 29, 1983

[54] X-RAY FILM AND MEDICAL RECORD ORGANIZER

[76] Inventor: J. W. Hatchell, P.O. Box 90684, Nashville, Tenn. 37209

[21] Appl. No.: 250,924

[22] Filed: Apr. 6, 1981

[51] Int. Cl.[3] ..... B65D 27/04; B65D 27/06; B65D 27/08; B65D 85/30

[52] U.S. Cl. ..... 206/455; 229/72; 150/39; 206/45.34; 383/106; 383/107; 383/109; 383/117

[58] Field of Search ..... 206/455, 45.34; 229/55, 229/72, 49; 150/39

[56] References Cited

U.S. PATENT DOCUMENTS

| | | | |
|---|---|---|---|
| 1,333,717 | 3/1920 | Jackson, Jr. | 229/55 |
| 1,928,337 | 9/1933 | McClanahan | 229/72 |
| 2,339,068 | 1/1944 | Frixione | 229/55 |
| 2,636,835 | 4/1953 | Boulware et al. | 229/49 |
| 3,089,634 | 5/1963 | Heise et al. | 229/49 |
| 3,435,868 | 4/1969 | Stermer | 150/39 |
| 3,490,507 | 1/1970 | Grashorn | 229/55 |
| 4,101,711 | 7/1978 | Stillman | 229/55 |
| 4,149,667 | 4/1979 | Riley | 229/72 |
| 4,192,447 | 3/1980 | Ambrosat et al. | 150/39 |

*Primary Examiner*—William T. Dixson, Jr.
*Attorney, Agent, or Firm*—Waddey & Newport

[57] ABSTRACT

An improved medical records organizer having an opaque back portion with a plurality of transparent vinyl sheets bonded along the bottom and side edges thereof to form a number of envelope portions for accepting and holding x-ray film and medical records. Nylon mesh impregnated reinforcing strips are adhesively bonded along the bottom and side edges and nylon seams sewn along the side edges to resist tearing of the envelope portion edges during normal use.

1 Claim, 11 Drawing Figures

X-RAY FILM AND MEDICAL RECORD ORGANIZER

FIELD OF INVENTION

This invention concerns improvements in the construction of x-ray film and medical record organizers, especially, but not limited to such organizers intended for filing, storing, and transporting x-ray film, medical records and the like.

DESCRIPTION OF PRIOR ART

X-ray film and medical record organizers with clear vinyl pockets are in wide use in the medical field. Organizers are used as a means of protection for X-ray film and medical records as these records are transported and stored throughout a medical institution. Such organizers are formed by heat or sonic sealing one or more sheets of transparent vinyl material along two sides and the bottom to a rigid vinyl backing with each sheet open at the top, forming one or more pockets to accept the x-ray film and medical record. As the seal is heat or sonic formed and less than one-eighth inch in width, continuous insertion and removal of the x-ray film and medical record subjects the plastic pocket to tearing along the sealing edge, resulting in a short useful life. The plastic pockets must be of clear vinyl to allow reading of reports placed inside the pockets without having to remove the reports from the pockets.

OBJECTS

It is the object of the present invention to provide an improved x-ray film and medical record organizer, with transparent pockets that will be non-tearing. The current method of heat or sonic sealing the pockets on the x-ray film and medical record organizer results in a weak attachment subject to tearing under minimum pressure. The present invention increases the tear resistance by reinforcing the narrow heat or sonic seal with a flap of nylon reenforced vinyl adhered with an adhesive and a seam sewn over, parallel and through the nylon re-enforced vinyl on either side and along the bottom. Further objects and advantages of my invention will become apparent from a consideration of the drawings and ensuing description thereof.

DESCRIPTION OF PREFERRED EMBODIMENTS

Figure 1:
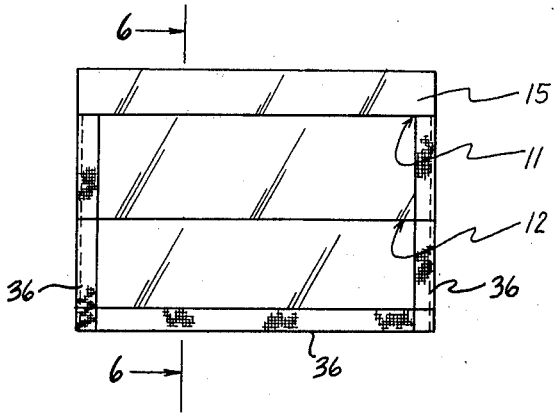
FIG. 1 is a front view of an improved medical records organizer embodying the present invention.
Figure 2:
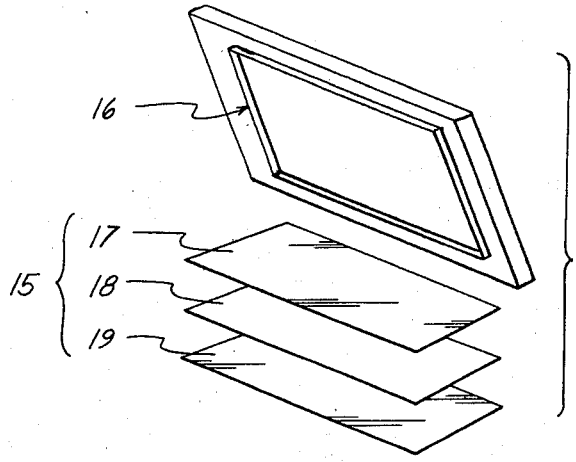
FIG. 2 is a schematic representation of a conventional heat seal process for manufacturing the opaque back portion of the medical records organizer embodying the present invention.
Figure 3:
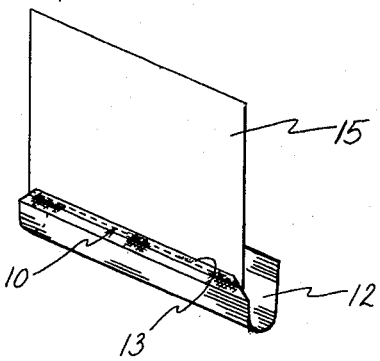
FIG. 3 is a perspective view of a partially assembled improved medical records organizer embodying the present invention showing the first envelope forming sheet attached to the rear surface of the opaque back portion.
Figure 4:
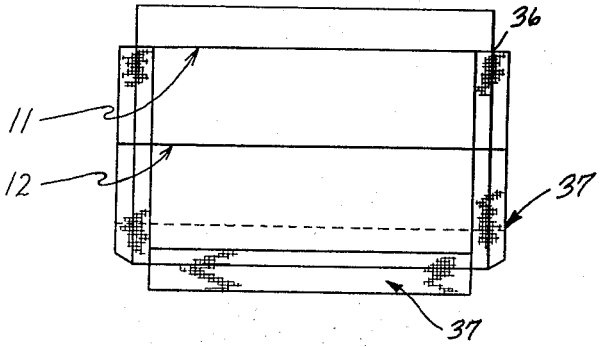
FIG. 4 is a front-view of a partially assembled improved medical records organizer embodying the present invention showing the envelope forming sheets attached to the front surface of the opaque back portion.
Figure 5:
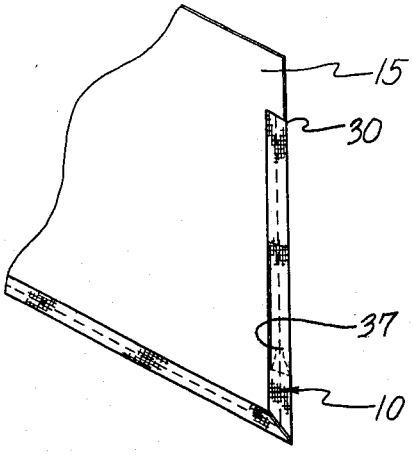
FIG. 5 is a partial perspective view of an improved medical records organizer embodying the present invention showing the attachment of the envelope forming sheets to the rear surface of the opaque back portion.
Figure 6:
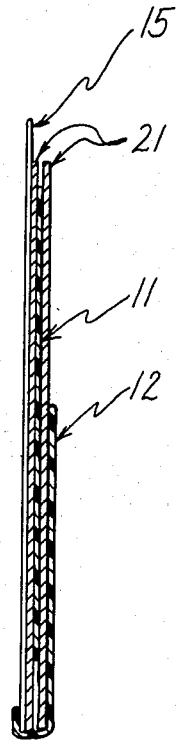
FIG. 6 is a cross-sectional view of the improved medical records organizer shown in FIG. 1, taken along lines 6—6 of FIG. 1.

FIG. 6 is a cross section showing the relative position of the re-enforced vinyl sheets 11,12 the opaque vinyl backing 15 and x-ray film and medical record 21 when inserted. It is shown that the x-ray film and medical record 21 are located at the extreme bottom of the formed clear pockets 11,12 as a result of the design and manufacture of the organizer.

Figure 7:
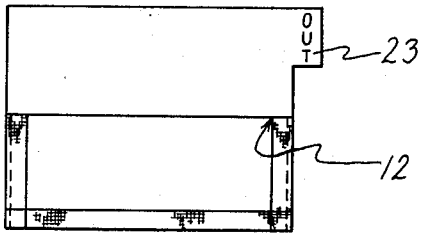
FIG. 7 is a front view of a second embodiment of an improved medical records organizer according to the present invention having a tab extending from the opaque back portion.
Figure 8:
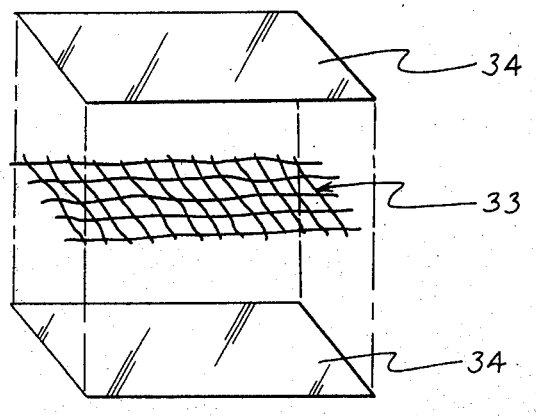
FIG. 8 is a schematic representation of the construction of the mesh-impregnated strips used to reinforce the edges of the improved medical records organizer embodying the present invention.
Figure 9:
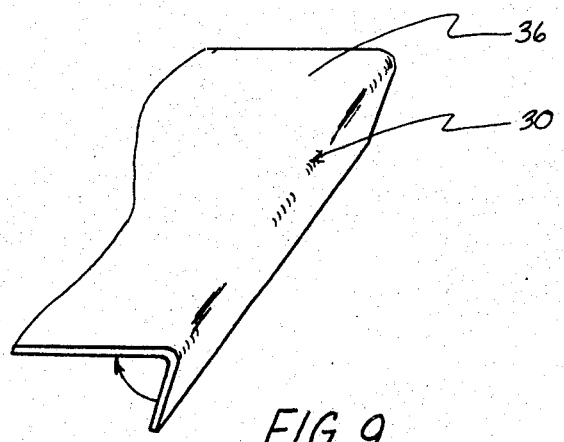
FIG. 9 is a partial perspective view of an envelope sheet partially folded prior to attachment to the opaque back portion of an improved medical records organizer embodying the present invention.
Figure 10:
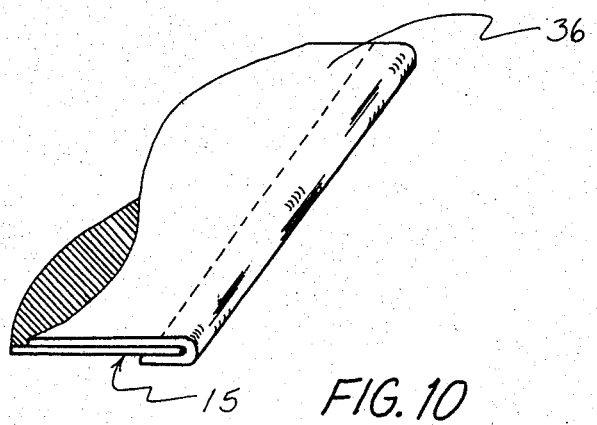
FIG. 10 is a partial perspective view of an envelope forming sheet superimposed and folded over the opaque back portion of an improved medical records organizer embodying the present invention.
Figure 11:
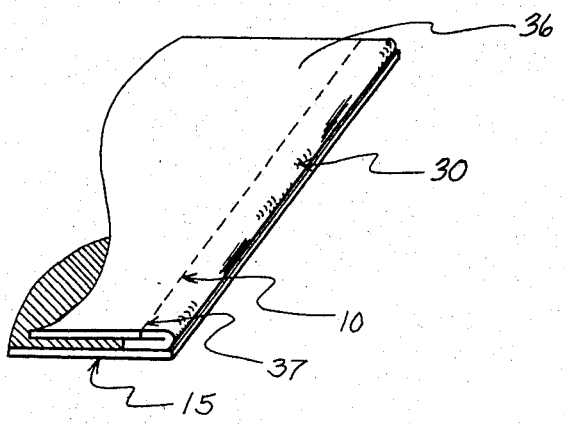
FIG. 11 is a partial perspective view of an alternative mode of attaching a folded envelope forming sheet to the opaque back portion of an improved medical records organizer embodying the present invention.

FIG. 7 shows an x-ray film and medical record organizer constructed as in the previously described method and a tab 23 imprinted with the word OUT attached in such a manner that said tab 23 would be visible when x-ray film or medical records are inserted into the said organizer pocket 12. Said tab 23 allows further organization of the x-ray film and medical records. This process is common in the art and is not a part of this patent application. Tear resistance of any two materials joined together is a function of the type, thickness, construction of the material, the amount of adhesive surface area in contact with each other and method of joining the two materials. The wider the adhesive surface between two materials the stronger the union between the said materials. FIG. 8 shows the construction of the re-enforced vinyl sheets, and is well known in the art and not a part of this patent application. A mesh formed of nylon or other suitable thread is impregnated between two thin sheets of vinyl material 34 such that each said nylon or thread location 33 acts as a new edge eliminating tearing of the said reinforced vinyl material. A cut can be made in the reinforced vinyl material a suitable distance and the said reinforced vinyl material will be resistant to further tearing at the end of the said cut. A cut in vinyl that has not been re-enforced will allow a tear to continue the entire length of the said vinyl material under minimum pressure.

it is also possible to fold the reinforced vinyl material over itself FIG. 11 attaching the fold 36 by an adhesive to the main body of the reinforced vinyl material 35 with said fold 36 creating a double thickness of reinforced vinyl material wherein said fold 30 can be attached to a second material 15 using an adhesive seal and sewn seam. The sewn seam 10 passes nylon or a suitable thread through and over the mesh of the reinforced vinyl in such a manner as to inter-lock the said nylon or thread 33 with the said mesh.

What I claim is:

1. An improved medical records organizer comprising the combination of:

a generally rectangular opaque back portion;

a first generally rectangular sheet of transparent vinyl material substantially superimposed over at least three adjoining edges of said back portion and bonded thereto along said three adjoining edges to form a first envelope portion having bonded sides and bottom and an open top;

a second generally rectangular sheet of transparent vinyl material substantially superimposed over said first transparent sheet and bonded thereto along said three adjoining bonded edges to form a second envelope portion having bonded sides and bottom and an open top;

reinforcing strips of nylon mesh impregnated flexible vinyl material wrapped around said three bonded edges and adhesively secured to said back portion and to said first and second transparent sheet; and seams sewn along the two of said bonded edges forming the sides of said envelope portions and stitched through said back portion, said first and second transparent sheets, and said reinforcing strips along said bonded sides, whereby tearing and separation of said envelope portions at the sides thereof is prevented.

* * * * *